US009702134B2

(12) United States Patent
Marini et al.

(10) Patent No.: US 9,702,134 B2
(45) Date of Patent: Jul. 11, 2017

(54) FRAGRANCE DELIVERY PRODUCT

(71) Applicants: Pamela Marini, Lebanon, NJ (US); Joseph Marini, Lebanon, NJ (US); Robert A. Marini, Trumbull, CT (US)

(72) Inventors: Pamela Marini, Lebanon, NJ (US); Joseph Marini, Lebanon, NJ (US); Robert A. Marini, Trumbull, CT (US)

(73) Assignee: Courtesy Creations, LLC, Lebanon, NJ (US)

( * ) Notice: Subject to any disclaimer, the term of this patent is extended or adjusted under 35 U.S.C. 154(b) by 2 days.

(21) Appl. No.: 14/516,670

(22) Filed: Oct. 17, 2014

(65) Prior Publication Data

US 2015/0111809 A1 Apr. 23, 2015

Related U.S. Application Data

(60) Provisional application No. 62/009,532, filed on Jun. 9, 2014, provisional application No. 61/892,324, filed on Oct. 17, 2013.

(51) Int. Cl.

| | |
|---|---|
| ***A61L 9/04*** | (2006.01) |
| ***A61K 8/00*** | (2006.01) |
| ***E03D 9/02*** | (2006.01) |

(52) U.S. Cl.

CPC ..... *E03D 9/022* (2013.01)

(58) Field of Classification Search

CPC ..... C11B 9/0003; E03D 9/022

USPC ..... 512/4, 1; 523/102, 1

See application file for complete search history.

(56) References Cited

U.S. PATENT DOCUMENTS

| | | | | |
|---|---|---|---|---|
| 5,783,541 | A | 7/1998 | Tack | |
| 6,054,423 | A | 4/2000 | McGill | |
| 6,121,215 | A * | 9/2000 | Rau | A61K 8/0204 510/130 |
| 6,387,321 | B1 | 5/2002 | McGill | |
| 6,432,450 | B1 * | 8/2002 | Gergely | A23L 1/302 424/466 |
| 6,939,841 | B2 | 9/2005 | Requejo | |
| 7,563,756 | B2 | 7/2009 | Brady | |
| 2004/0266638 | A1 | 12/2004 | Requejo | |
| 2006/0133395 | A1 | 6/2006 | Park | |
| 2008/0146487 | A1 * | 6/2008 | O'Connor | A61K 8/02 512/4 |
| 2009/0081755 | A1 * | 3/2009 | Schmiedel | C11D 3/50 435/183 |
| 2010/0034889 | A1 * | 2/2010 | Rau | A23L 2/395 424/489 |

* cited by examiner

*Primary Examiner* — Jessica E Whiteley
(74) *Attorney, Agent, or Firm* — Thomas M. Finetti; Charney IP Law LLC

(57) ABSTRACT

In another aspect of the present invention is a solid formulation comprising an effervescent agent and a fragrance, wherein the formulation has a specific gravity relative to water of less than 1. In a further aspect of the present invention is a kit comprising a formulation comprising an effervescent agent, a fragrance, a preservative, and a chelating agent; and a packaging, e.g. a sachet.

13 Claims, 1 Drawing Sheet

FRAGRANCE DELIVERY PRODUCT

CROSS REFERENCE TO RELATED APPLICATIONS

The present application claims the benefit of the filing date of U.S. Provisional Patent Application No. 61/892,324 filed Oct. 17, 2013 and U.S. Provisional No. 62/009,532 filed Jun. 9, 2014, the disclosures of which are hereby incorporated herein by reference.

BACKGROUND OF THE INVENTION

Of concern among those using restrooms, either at home or in public, is either leaving behind an undesirable odor for the next occupant or having to withstand a preexisting undesirable odor while using the facility. To date there have been attempts to remedy this situation.

For example, it is known to spray liquid fragrance as an aerosol into the air in the restroom in an attempt to mask or otherwise conceal the odor. One downside of this attempt is that the aerosol liquid is typically contained in a relatively large delivery vessel and cannot be carried discretely by an individual. Aerosols also deliver fragrance throughout the room and not necessarily directly at the source of the odor.

Attempts have been made to spray liquid fragrance directly into a toilet vessel. While these types of delivery devices can be discretely carried by an individual, it has been found that fragrance delivery in this manner is inconvenient.

Attempts have also been made to utilize effervescent solids to deliver fragrance directly into the toilet vessel. While these types of delivery devices can be discretely carried by an individual, it has been found that fragrance delivery in this manner is inefficient. Because the effervescent solid typically sinks to the bottom of the toilet vessel, some of the fragrance is trapped by liquid or other debris (i.e. fecal matter, toilet tissue, etc.) in the toilet vessel. Those trapped fragrances become waste as they fail to reach the surface of the water where they could otherwise volatilize and fragrance the room. Instead, they are eliminated through the flushing cycle.

It would therefore be advantageous to provide a fragrance delivery product that would overcome these issues.

BRIEF SUMMARY OF THE INVENTION

In one aspect of the present invention is a fragrance delivery product for alleviating, preventing, or mitigating restroom odors. In some embodiments, the fragrance delivery product is provided in the form of an effervescent solid formulation, which floats, at least partially floats, or remains close to the surface of the water (collectively referred to herein as "floats" or "floating"). In some embodiments, the effervescent solid formulation is a powder, a granulate material, a tablet, or any combination thereof.

Without wishing to be bound by any particular theory, it is believed that the floating and effervescent nature permits a fragrance to quickly and efficiently disburse or distribute either onto the surface of the water and/or from the surface of the water into the atmosphere of the restroom facility, preferably without otherwise being trapped by water or debris in the toilet vessel. It can also be envisioned that some of the fragrance may disperse directly into the atmosphere.

In some embodiments, the fragrance disperses or is distributed as a film onto the surface of the water contained in the toilet vessel. In some embodiments, the film may act as a barrier (chemical or physical) preventing or mitigating odors from the surface of water or beneath the surface of water from escaping into the atmosphere. In particular, it is considered advantageous for the product to float, disintegrate and/or dissolve quickly such that no visual evidence, or limited visual evidence, of the product remains in a toilet vessel after flushing and upon the entrance of a second individual following use by a first.

In another aspect of the present invention is a solid formulation comprising an effervescent agent and a fragrance, wherein the formulation floats and effervesces. In another aspect of the present invention is a solid formulation comprising an effervescent agent and a fragrance, wherein the formulation has a specific gravity relative to water of less than 1 and wherein the formulation begins to effervesce immediately or shortly after contacting water. In some embodiments, the formulation begins to effervesce immediately upon contacting water. In other embodiments, the formulation begins to effervesce within one second of contacting water. In yet other embodiments, the formulation begins to effervesce within about 0.25 seconds to about 20 seconds after contacting water. In yet other embodiments, the formulation begins to effervesce within about 0.5 seconds to about 10 seconds after contacting water. In some embodiments, the effervescence continues for up to about a minute after being delivered to water. In some embodiments, the effervescence will continue from 20 seconds to about 120 seconds after initial effervescence.

In some embodiments, the formulation further comprises a preservative. In some embodiments, the preservative is sodium benzoate. In some embodiments, the formulation further comprises a chelating agent. In some embodiments, the chelating agent is EDTA. In some embodiments, the effervescent agent comprises an acidic component and a basic component. In some embodiments, the acidic component is selected from the group consisting of citric acid, tartaric acid, maleic acid, fumeric acid, adipic acid succinic acid, citric anhydride, succinate anhydride, sodium dihydrogen phosphate, disodium dihydrogen pyrophospahe, and sodium acid sulfite; and wherein the basic component is selected from the group consisting of sodium bicarbonate, sodium carbonate, potassium bicarbonate, potassium carbonate, sodium sesquicarbonate, and sodium glycine carbonate. In some embodiments, the acidic component is citric acid and the basic component is sodium carbonate.

In some embodiments, the formulation further comprises a granulating agent. In some embodiments, the granulating agent is a polyethylene glycol. In some embodiments, the formulation is in the form of a granulate. In some embodiments, the formulation is compressed into a tablet. In some embodiments, the formulation comprises an amount of fragrance ranging from between about 10% to about 25% by total weight of the formulation.

In yet another aspect of the present invention is an effervescent bi-layer tablet comprising a first portion comprising an effervescent agent, and a fragrance; and a second portion comprising at least one component selected to decrease the specific gravity or enhancing the buoyancy of the bi-layer tablet relative to water. In some embodiments, the second portion comprises a swellable polymer.

In a further aspect of the present invention is a kit comprising a formulation comprising an effervescent agent, and a fragrance; and a packaging, e.g. a sachet. In some embodiments, the packaging is biodegradable. In some embodiments, the biodegradable packaging is formed from a material selected from the group consisting of gelatins, celluloses, or other biodegradable materials. In some embodiments, the kit at least floats or partially floats on a surface of water. In some embodiments, the kit effervesces for at least about 30 seconds after it contacts water. In some embodiments, the packaging comprises a foil, such an aluminum foil, or biodegradable packing that can be disposed into the toilet as waste.

In yet a further aspect of the present invention is a method comprising dispensing a formulation comprising an effervescent agent and a fragrance to a surface of water, wherein the formulation floats or at least partially floats on the water surface, and wherein the fragrance is released, dispersed, or distributed either onto the surface of water and/or into an atmosphere surrounding the water surface. The fragrance, while floating on the surface, may create a physical barrier as described herein.

In yet a further aspect of the present invention is a sachet comprising an air tight or moisture tight material, the sachet comprising an effervescent solid formulation designed to float, effervesce, and release fragrance.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

With respect to the drawings.

DETAILED DESCRIPTION

Figure 2:
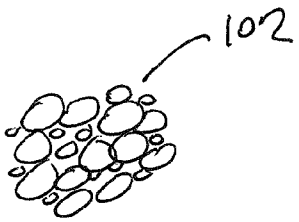
FIG. 2 depicts a fragrance delivery product in accordance with a second embodiment of the present invention.

In the following are described the preferred embodiments of the fragrance delivery product in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

In one aspect of the present invention is a formulation comprising an effervescent agent and a fragrance. In another aspect of the present invention is a formulation comprising an effervescent agent and a fragrance, and optionally at least one of a preservative or a chelating agent. In another aspect of the present invention is a formulation comprising an effervescent agent, a fragrance, a preservative, and a chelating agent.

Generally, the amount of effervescent agent ranges from about 30% to about 90% by total weight of the composition. In some embodiments, the amount of effervescent agent ranges from about 40% to about 90% by total weight of the composition. In some embodiments, the effervescent agent ranges from about 50% to about 85% by total weight of the composition. In other embodiments, the effervescent agent ranges from about 50% to about 60% or about 75% to about 85%, depending on the presence of additional inactive ingredients (e.g. granulating agents or binders).

The effervescent agent may be a single component or a mixture of two or more components, provided that the effervescent agent suitably provides for a sufficient release of a gas (e.g. carbon dioxide or oxygen) to carry out the objectives of the present (e.g. to allow for a fragrance to escape the solid formulation and disperse or volatize into an atmosphere). Specific effervescent agents are well known in the art. For example, anhydrous sodium perborate is an effervescent agent that, when it contacts water, reacts to release oxygen gas.

In embodiments where the effervescent agent is a mixture of two components, the components are selected one from an acid and the other from a base, such that, upon contact with water, the acid and base react to release a gas. Suitable acids, without limitation, include citric acid, tartaric acid, maleic acid, fumeric acid, adipic acid succinic acid, citric anhydride, succinate anhydride, sodium dihydrogen phosphate (mono sodium phosphate), disodium dihydrogen pyrophospahe (sodium phosphate pyrophosphate), and sodium acid sulfite (sodium bisulfate). Suitable bases, without limitation, include sodium bicarbonate, sodium carbonate, potassium bicarbonate, potassium carbonate, sodium sesquicarbonate, and sodium glycine carbonate.

In one embodiment, the effervescent agent is a mixture of sodium carbonate and citric acid.

The ratio of the acidic component to the basic component may vary based on the acid and base chosen. In some embodiments, the ratio of acid to base ranges from 1:2 to 2:1. In other embodiments, the ratio of acid to base ranges from about 1.5:1 to about 1:1.5. In yet other embodiments, the ratio of acid to base ranges from about 1.75:1 to about 1:1.75. In yet other embodiments, the ratio of acid to base ranges from about 0.83:1 to about 1:0.83.

Without wishing to be bound by any particular theory, it is believed that the optimal stoichiometric ratio of citric acid and sodium bicarbonate for gas generation is reported to be about 0.76:1.

The fragrance may be selected from a wide range of fragrance materials which are well known to those skilled in the art and include, inter alia, alcohols, ketones, aldehydes, esters, ethers, nitrites, and alkenes such as terpenes. A listing of common fragrance materials can be found in various reference sources, for example, "Perfume and Flavor Chemicals", Vols. I and II; Steffen Arctander Allured Pub. Co. (1994) and "Perfumes: Art, Science and Technology"; Muller, P. M. and Lamparsky, D., Blackie Academic and Professional (1994). In some embodiments, the fragrance may be selected from any of volatile oil, fragrance essences, or mixtures thereof. Examples of oils include allspice, juniper, basil, cinnamon, sage, camphor, cedar, ginger, orange, lime, lemon, rose, and jasmine. In some embodiments, the fragrance is selected such that the vapors are pleasant to the senses. In other embodiments, the fragrance is chosen such that it easily volatizes or vaporizes into an atmosphere.

The amount of fragrance may vary depending on the type of oils or essences used and their relative potencies. Generally, the amount of fragrance ranges from about 8% to about 22% by total weight of the formulation. In some embodiments, the amount of fragrance ranges from about 10% to about 20% of the total weight of the formulation. In other embodiments, the amount of fragrance ranges from about 13% to about 18% by total weight of the formulation.

The formulation may also comprise a preservative, which may be selected from any suitable preservative agent typically used in the cosmetic, pharmaceutical, and food industries. In one embodiment, the preservative is sodium benzoate. Typically, the preservative is present in an amount ranging from about 0.075% to about 2% by total weight of the formulation.

A chelating agent may also be included in the formulation and may be selected from any suitable agent known to those of skill in the art. For example, the chelating agent may be ethylenediaminetetraacetic acid ("EDTA"). Typically, the chelating agent is present in an amount ranging from about 0.05% to about 0.5% by total weight of the formulation.

In some embodiments, the formulation further comprises a granulating agent. In some embodiments, the granulating agent is a polyethylene glycol ("PEG"), such as PEG 8000. Other PEGs may be used provided they meets the criteria of the claimed invention and one of skill will be able to select such a PEG and the amounts necessary to arrive at the claimed invention. The granulating agent, in some embodiments, is present in an amount of between about 10% to about 50% by total weight of the formulation. In some embodiments, the granulating agent is present in an amount ranging from about 20% to about 40% by total weight of the formulation. In some embodiments, the granulating agent is present in an amount ranging from about 25% to about 35% by total weight of the formulation. In other embodiments, the granulating agent is present in an amount ranging from about 27.5% to about 32.5% by total weight of the formulation.

The formulation may also comprise additional components such as binders, lubricants, and fillers. Polyvinylpyrrolidone ("PVP") is an example of one binder suitable for inclusion within the formulation of the present invention. Lubricants include powdered sodium benzoate, micronized PEG (e.g. PEG 4000 or PEG 6000), sodium stearate, sodium oleate, cottonseed oil, corn oil, and mineral oil. The additional component, if included, may be present in an amount ranging from about 0.05% to about 15% of the total weight of the formulation.

The formulation may be prepared as a powder or a granulate material (e.g. granules, microspheres, beads) provided that regardless of the form of the formulation, the formulation floats and is effervescent. FIG. 2 provides an example of granules 102. Note that the granule sizes may vary, as shown, or may be consistently sized.

In some embodiments, the granules may be milled to generate a particle size distribution to optimize product performance. It is understood that none, some or all of the granules may be milled to generate various size granules. It is understood that a powder blend containing the formulation components that have not been previously granulated either through a dry or wet granulation process may be added to the granulation at some proportion of the final blend.

The chemical composition of the granules may either be homogenous, such that components and quantities of the components constituting the granules are identical. In other embodiments, the chemical composition is heterogeneous, such that the components and/or quantities of the components constituting of each of the granules is not identical. Some powders and/or granules may be coated with additional fragrance or coatings containing fragrance, while others may not.

Figure 1:
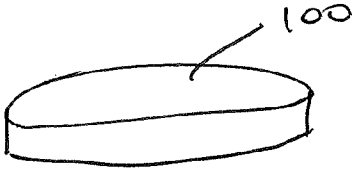
FIG. 1 depicts a fragrance delivery product in accordance with a first embodiment of the present invention.

The powder formulation and/or granulate formulation may be further processed, such as compressed into tablets. As shown in FIG. 1, a fragrance delivery product may be delivered in the form of a tablet 100. The tablet 100 may be configured in a slender cylindrical form as shown or may be configured to other geometric or non-geometric configurations. Of course, the tablet may have any size and/or shape and/or have any weight, provided that the tablet sufficiently meets the desired performance criteria, namely effervescing, able to at least partially float, and deliver fragrance. In some embodiments, the total weight of the tablet 100 will be less than about 15 grams and, in some embodiments, the tablet will weigh between about to 5 to about 10 grams.

In some embodiments, the tablet may be a multi-layer tablet, such as a bi-layer tablet. In this example, one layer may comprise non-effervescent components, such as swellable polymers (e.g. polysaccharide, polypropylene, polystyrene, or biodegradable foam). A second layer may comprise the formulation of the present invention, including the effervescent agent. Here, it is believed that the non-effervescent components will aid the fragrance delivery product in floating, i.e. it will lower the specific gravity of the tablet or enhance its buoyancy. This bi-layer product can be used, for example, in situations where the components comprising the effervescent portion do not permit the tablet to adequately float. In some embodiments, the non-effervescent portion also comprises fragrance. Of course, the non-effervescent portion may also comprise effervescent agents, although to a lesser degree than contained in the effervescent portion.

Regardless of the form of the formulation or composition of the present invention, the formulation (powder, granulate material, tablet, or combination thereof) is designed to float on the surface of water, at least partially float on the surface of water, or where at least a portion of the solid material comprising the powder, granule, or tablet periodically reaches the surfaces while it effervesces. In some embodiments, the formulation possesses a specific gravity, as compared with water, of about less than 1. The formulation is designed to float immediately or shortly after contacting water.

The formulation of the present invention is also designed to effervesce immediately or shortly after contacting water. In some embodiments, the formulation beings to effervesce immediately upon contacting water. In other embodiments, the formulation begins to effervesce within one second of contacting water. In yet other embodiments, the formulation begins to effervesce within about 0.25 seconds to about 20 seconds after contacting water. In yet other embodiments, the formulation begins to effervesce within about 0.5 seconds to about 10 seconds after contacting water. In some embodiments, the effervescence continues for up to about a minute after being delivered to water. In some embodiments, the effervescence will continue from 20 seconds to about 120 seconds after initial effervescence.

In some embodiments, the fragrance disperses or is distributed as a film (evenly or unevenly) onto the surface of the water contained in the toilet vessel. It is believed that the fragrance will then disperse (e.g. volatilize or vaporize) from the film into an atmosphere above the surface of water. In some embodiments, the film may act as a barrier (chemical or physical) preventing or mitigating odors from the surface of water or beneath the surface of water from escaping into the atmosphere.

In some embodiments, the formulation floats and effervesces and provides for a quantity of fragrance to be released to the water surface and ultimately to an atmosphere surrounding the surface of the water onto which the formulation is applied. A sufficient quantity of the formulation is provided to the surface of the water such that any odor in the atmosphere is at least partially masked. For example, in use it is desirable that a sufficient amount of formulation be supplied to the surface of water in a toilet vessel such that when the formulation comes into contact with water and begins to effervesce, a fragrance is released such that any odors in or around the vicinity of the toilet vessel may be at least partially masked, and that a quantity of fragrance is released such that the odor is masked for an average sized adult within the immediate vicinity of the toilet vessel.

While the formulation may only effervesce for a limited period of time, such as those times provided herein, the fragrance may persist for a time after effervescence release. The amount of time that the fragrance persists after effervescence is based on the particular fragrance chosen; the quantity of fragrance in the formulation (i.e. the total weight percentage of the fragrance in the formulation); the total amount of formulation (powder, granular material, and/or tablet) placed in contact with the surface water within the toilet vessel; and the duration that the fragrance persists on the surface of the water. For example, if the water in the toilet vessel is cycled within 30 seconds, the fragrance will have only seconds to enter the atmosphere surrounding the toilet vessel.

It will be appreciated that effervescence will be achieved quickly such that visual evidence of the product will partially or completely disappear before another user enters the stall or restroom facility.

In another aspect of the present invention is a fragrance delivery product or packaging designed to hold and then release the formulation of the present invention. The packaging may hold the formulation as a powder, granulate, tablet (multi-layer or otherwise), or any mixture or combination thereof.

Figure 3:
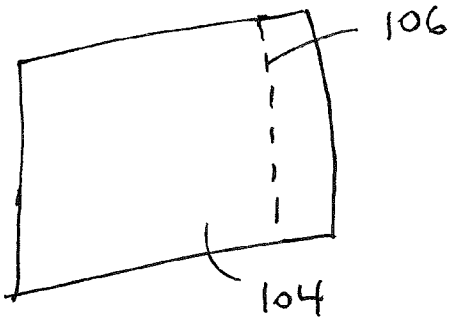
FIG. 3 depicts a delivery sachet for housing and delivering a fragrance delivery product.

Shown in FIG. 3 is a delivery sachet 104. In preferred embodiments, the delivery sachet 104 is sized and configured to house a single dose of fragrance delivery product either in tablet 100 form, granulate 102 form, powder form, or any mixture or combination thereof. In some embodiments, the sachet 104 is water and vapor tight to prevent unintended effervescence before use. Possible materials for the sachet 104 include aluminum foil or various plastics. In some embodiments, the material for the sachet is selected from a material that is hydrophobic. It is also considered that the sachet 104 may itself be biodegradable.

For example, the sachet material may be selected from a biodegradable polymer, copolymer, or blend. In some embodiments, the biodegradeable material is selected from gelatins, celluloses, and other biodegradeable polymers and materials.

The skilled artisan will appreciate that a sufficient amount of the composition of the present invention should be supplied in any single use sachet to meet the desired performance criteria, namely the ability of the formulation to effervesce, float, and deliver fragrance. In some embodiments, the total weight of formulation material in a typical single use delivery sachet is under about 30 grams. In other embodiments, the total weight of formulation material in a typical single use delivery sachet is under about 25 grams. In yet other embodiments, the total weight of formulation material in a typical single use delivery sachet is under 20 about grams. In further embodiments, the total weight of formulation material in a typical single use delivery sachet ranges from about 5 grams to about 15 grams.

In use, it is anticipated that the user will tear open the sachet 104 at a locally weakened area such as a perforated area 106 or a notched area. The user may then disburse the contents of the sachet 104 into an open toilet vessel prior to or just after using the facility, but in any event prior to exiting the stall or restroom facility. In the case of a biodegradable sachet, the user may also dispense the wasted sachet 104 into the open toilet vessel.

In the case of a biodegradable sachet 104, the entire sachet may be dropped in the toilet vessel with or without being opened. The biodegradeable sachet 104 will dissolve exposing the fragrance delivery product to the fluids in the toilet vessel. Again, it is anticipated that visual evidence of the fragrance product, including the biodegradable sachet 104, will partially or completely disappear before another user enters the restroom facility.

Due to the nature of the fragrance delivery product, it will quickly effervesce and deliver airborne fragrance to an atmosphere within the immediate area surrounding the toilet vessel and, likely, beyond.

In another aspect is a method comprising dispensing a formulation comprising an effervescent agent and a fragrance to a surface of water, wherein the formulation at least partially floats on the water surface, and wherein the fragrance is released into an atmosphere surrounding the water surface. In some embodiments, the film may act as a barrier (chemical or physical) preventing or mitigating odors from the surface of water or beneath the surface of water from escaping into the atmosphere.

In another aspect of the present invention is a kit comprising a formulation comprising an effervescent agent and a fragrance; and a packaging. In some embodiments, the packaging is biodegradable. In some embodiments, the entire kit at least partially floats on a surface of water. In some embodiments, the kit effervesces immediately or shortly after contacting water, and as described herein. In some embodiments, the packaging comprises a foil, such as aluminum foil. In some embodiments, the packaging is notched such that is easy to open or tear open in a manner in which the contents could be easily distributed to the surface of water, such as water in a toilet vessel. In some embodiments, the kit further includes instructions for use, such as instructions for distributing the formulation of the present invention to the surface of water. The instructions could be in the form of icons of symbols rather than words.

Specific formulations of a fragrance delivery product are presented below.

Formula I

Formula I represents a powder formulation with about 17% fragrance by total weight of the composition, as follows:

| Component | Weight (grams) | Total weight (%) |
|---|---|---|
| Sodium Carbonate | 99.6 | 37.4 |
| Citric Acid | 120 | 45.1 |
| Fragrance | 45 | 16.9 |
| Sodium Benzoate | 1.4 | 0.5 |
| Ethylenediaminetetraacetic Acid | 0.27 | 0.1 |
| Total | 266.3 | 100 |

The total amount of effervescent agent in Formula I is 219.6 grams, representing 82.5% of the total weight of the formulation.

Each component listed for Formula I was carefully weighed and measured. The solid ingredients were geometrically added together while the liquid ingredients were slowly added while the mixture was thoroughly stirred. The resulting powder was then added to a tightly sealed package, such as those described herein.

Granules may be prepared from any powder blend formulation, such as Formulation I, and as disclosed in Formula II.

Formula II

Formula II represents a granulate formulation with about 15% fragrance by total weight of the composition, as follows:

| Component | Weight (grams) | Total weight (%) |
|---|---|---|
| Sodium Carbonate | 66.4 | 24.7 |
| Citric Acid | 80 | 29.9 |
| Fragrance | 40 | 14.9 |
| Sodium Benzoate | 1.3 | 0.49 |
| Polyethylene Glycol (PEG) 8000 | 80 | 29.9 |
| Ethylenediaminetetraacetic Acid | 0.26 | 0.097 |
| Total | 268 | 100 |

Granulation techniques are generally known to those of ordinary skill in the art. In some embodiments, if one wishes to form a large batch of such a granulate material, they may accurately weigh or measure each ingredient required for the formula and then add all of the ingredients to a Single Pot processor. The mixture should be heated to about 60-63° C., the melting temperature of PEG 8000. In this step, one should take caution not to overheat. Moreover, if fire hazard is a concern, a lower temperature to soften the PEG 8000 is also workable. Heat should then be removed while continuing to rotate the Single Pot to mix.

The mixture should then be removed from the Single Pot and passed through a USP#10 sieve (aperture 2 mm). The granules that fail to pass through the sieve may be ground and passed again through the sieve. Those particles passing through the sieve may then be packaged in the package of the present invention.

In other embodiments, if one wishes to form a smaller quantity of granulate material, they may accurately weigh or measure each ingredient required for the formula. They may then geometrically mix the citric acid, sodium carbonate, preservative (Sodium Benzoate), and chelating agent (Ethylenediaminetetraacetic Acid). The PEG 8000 is then melted on a hot plate. Note that the melting temperature of PEG 8000 is from about 60-63° C. and that the PEG 8000 should not be overheated. Moreover, if fire is a concern, a lower temperature to soften the PEG 8000 is workable. Heat should then be reduced while the fragrance is blended into the PEG 8000.

While the fragrance and PEG 8000 is still on the hot plate, the geometrically mixed citric acid, sodium carbonate, preservative, and chelating agent is then added. Note that it is essential to homogeneously distribute the PEG 8000 among the other ingredients before the PEG 8000 solidifies. The material should then be sieved through a USP#10 sieve (aperture 2 mm). The granules that fail to pass the sieve should be further ground. An additional 1-2 grams of fragrance may then be added to the granules to compensate for losses. The granules may then be packaged as disclosed herein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A solid formulation comprising an effervescent agent and a fragrance, wherein said formulation has a specific gravity relative to water of less than 1, and wherein said fragrance is at least partially dispersed or distributed to a water surface, wherein an amount of said effervescent agent ranges from between about 40% to about 90% by total weight of the solid formulation, wherein an amount of said fragrance ranges from between about 8% to about 22% by total weight of the formulation; and wherein the solid formulation is in the form of a granulate, wherein said formulation consists essentially of an effervescent agent, a fragrance, a preservative, a granulating agent, and a chelating agent.

2. The solid formulation of claim 1, wherein said fragrance forms a film on the surface of said water.

3. The solid formulation of claim 1, wherein said fragrance at least partially volatilizes or vaporizes into an atmosphere surrounding said water surface.

4. The solid formulation of claim 1, wherein said effervescent agent comprises an acidic component and a basic component.

5. The solid formulation of claim 4, wherein said acidic component is selected from the group consisting of citric acid, tartaric acid, maleic acid, fumeric acid, adipic acid succinic acid, citric anhydride, succinate anhydride, sodium dihydrogen phosphate, disodium dihydrogen pyrophospahe, and sodium acid sulfite; and wherein said basic component is selected from the group consisting of sodium bicarbonate, sodium carbonate, potassium bicarbonate, potassium carbonate, sodium sesquicarbonate, and sodium glycine carbonate.

6. The solid formulation of claim 4, wherein said acidic component is citric acid and said basic component is sodium carbonate.

7. The solid formulation of claim 4, wherein said granulating agent is a polyethylene glycol.

8. The solid formulation of claim 1, wherein said formulation effervesces for a time raging from about 0.25 seconds to about 120 seconds.

9. The solid formulation of claim 1, wherein said formulation comprises an amount of fragrance ranging from between about 10% to about 20% by total weight of said formulation.

10. The solid formulation of claim 1, wherein said formulation comprises an amount of fragrance ranging from between about 13% to about 18% by total weight of the formulation.

11. A solid formulation comprising an effervescent agent and a fragrance, wherein said formulation has a specific gravity relative to water of less than 1, and wherein said fragrance is at least partially dispersed or distributed to a water surface, wherein an amount of said effervescent agent ranges from about 30% to about 90% by total weight of the solid formulation, wherein the solid formulation is in the form of a powder, wherein said formulation consists essentially of an effervescent agent, a fragrance, a preservative, and a chelating agent.

12. The solid formulation of claim 11, wherein an amount of the effervescent agent ranges from about 50% to about 85% by weight of the formulation.

13. The solid formulation of claim 11, wherein an amount of the effervescent agent ranges from about 75% to about 85% by weight of the formulation.

* * * * *